US006752550B2

(12) United States Patent
Toyofuku et al.

(10) Patent No.: US 6,752,550 B2
(45) Date of Patent: Jun. 22, 2004

(54) HOLDING MECHANISM FOR REPLACEMENT INK RIBBON

(75) Inventors: Toshiyuki Toyofuku, Tokyo-To (JP); Hiroyuki Kaneko, Tokyo-To (JP); Satoru Kato, Tokyo-To (JP); Yousuke Kobayashi, Tokyo-To (JP); Hisashi Yamada, Tokyo-To (JP); Katsuyuki Oshima, Tokyo-To (JP); Kozo Odamura, Tokyo-To (JP); Takayuki Imai, Tokyo-To (JP)

(73) Assignees: Olympus Optical Co., LTD (JP); Mitsubishi Denki Kabushiki Kaisha (JP); Dai Nippon Printing Co., Ltd. (JP)

( * ) Notice: Subject to any disclaimer, the term of this patent is extended or adjusted under 35 U.S.C. 154(b) by 0 days.

(21) Appl. No.: 10/070,734

(22) PCT Filed: Jul. 13, 2001

(86) PCT No.: PCT/JP01/06106

§ 371 (c)(1),
(2), (4) Date: Mar. 25, 2002

(87) PCT Pub. No.: WO02/06053

PCT Pub. Date: Jan. 24, 2002

(65) Prior Publication Data

US 2002/0164186 A1 Nov. 7, 2002

(30) Foreign Application Priority Data

Jul. 13, 2000 (JP) ..... 2000-212858
Jul. 13, 2000 (JP) ..... 2000-212860

(51) Int. Cl.[7] ..... B41J 35/28
(52) U.S. Cl. ..... 400/207; 400/208; 206/410; 206/415; 396/514
(58) Field of Search ..... 400/207, 208, 400/208.1; 206/404, 406, 410, 415; 396/513, 514

(56) References Cited

U.S. PATENT DOCUMENTS

| | | | | | |
|---|---|---|---|---|---|
| 3,001,644 | A | * | 9/1961 | Fourness et al. | 206/449 |
| 3,288,323 | A | * | 11/1966 | Schechter | 220/270 |
| 3,530,980 | A | * | 9/1970 | Link | 206/394 |
| 4,285,461 | A | * | 8/1981 | Meyers | 229/123.2 |
| 4,605,142 | A | * | 8/1986 | Itoh et al. | 220/359.4 |
| 5,110,228 | A | * | 5/1992 | Yokomizo | 400/208 |
| 5,203,455 | A | | 4/1993 | Hewelt et al. | 206/333 |
| 5,399,035 | A | | 3/1995 | Nakae | 400/207 |
| 5,415,486 | A | * | 5/1995 | Wouters et al. | 400/692 |
| 5,865,545 | A | * | 2/1999 | Kondo | 400/207 |

FOREIGN PATENT DOCUMENTS

| | | |
|---|---|---|
| JP | 2-48981 | 2/1990 |
| JP | 2-204074 | 8/1990 |
| JP | 7-61081 | 3/1995 |
| JP | 8-310091 | 11/1996 |
| JP | 10-315558 | 12/1998 |

* cited by examiner

*Primary Examiner*—Andrew H. Hirshfeld
*Assistant Examiner*—Dave Ghatt
(74) *Attorney, Agent, or Firm*—Parkhurst & Wendel, L.L.P.

(57) ABSTRACT

A holding mechanism 10 for holding an ink ribbon 20 includes a transparent shell 11 and a board 12. The transparent shell 11 of the ink ribbon 20 is provided with wind slack preventive portions 11*a* to 11*d* which prevent rotations of a feed bobbin 21 and reel bobbin 22, and wind meandering preventive portions 11*e*, 11*f* which bears down an axial end 23*a* of a film 23. The ink ribbon 20 can be stably held by the holding mechanism 10 during a transportation and a loading thereof. The transparent shell 11 is provided with support portions 11*g*, 11*f* which improve a stability when loading.

20 Claims, 8 Drawing Sheets

HOLDING MECHANISM FOR REPLACEMENT INK RIBBON

FIELD OF THE INVENTION

The present invention relates to a holding mechanism for holding a replacement ink ribbon to be used for a printer which carries out a thermal transfer printing.

RELATED ART

As a thermal transfer recording method, a sublimating transfer recording method, for example, has been remarked which forms an image on a thermal transfer image receiving sheet by heating a thermal transfer film having a thermal transfer layer containing a sublimating dye formed on a support body such as polyester film by means of a thermal head or laser, etc.

Since the thermal transfer film to be used for these purposes is loaded in a thermal transfer printer to be consecutively used, the thermal transfer film is used in a form of an ink ribbon having a pair of feed bobbin including wound bobbin roll and a reel bobbin for reeling. In the conventional ink ribbon, the feed bobbin having the film provided thereon and the reel bobbin are received in a cassette exclusively used for the film.

However, the above-described conventional ink ribbon is sold with the ink ribbon received in a film cassette. Thus, the price can not be reduced. Particularly, a printer instrument in these days which corresponds to an enlarged print size needs a larger film cassette, because the size of the required ink ribbon is also enlarged. Thus, the price of the ink ribbon is increased as well as resources have been wasted.

It may be considered that the feed bobbin having the film provided thereon and the reel bobbin are supplied just as they are, without using the film cassette.

However, such a form is not user-friendly, as a user may accidentally touch the film during loading the ink ribbon in the printer instrument, or the wind of the film may be slipped, etc. With a printer for business use employed in only a plant or others, there may be no problem because a technical personnel having an expertise uses the printer. However, with a household printer instrument, users are unspecified, and it is difficult to deal with an ink ribbon without using a film cassette.

SUMMARY OF THE INVENTION

An object of the present invention is to provide an inexpensive holding mechanism for a replacement ink ribbon which can supply, without using a film cassette, a feed bobbin with a film provided thereon and a reel bobbin as they are, and can stably hold an ink ribbon during transportation and loading of the replacement ink ribbon.

The holding mechanism for holding a replacement ink ribbon according to the present invention comprises a feed bobbin provided at one end of a strip film and a reel bobbin provided at the other end of the strip film, comprising a first holding member having a feed bobbin receiving portion for receiving and holding the feed bobbin and a reel bobbin receiving portion for receiving and holding the reel bobbin, with the first holding member having an opening, and a second holding member having a plate-shape for covering the opening of the first holding member.

In the holding mechanism, a wind slack preventive portion may be provided in at least one of the feed bobbin receiving portion and the reel bobbin receiving portion, for preventing a rotation of the feed bobbin or the reel bobbin.

In the holding mechanism, the feed bobbin and the reel bobbin may respectively include flanges at both ends thereof, and the feed bobbin receiving portion and the reel bobbin receiving portion may include flange receiving portions for receiving the corresponding flanges.

In the holding mechanism, a lock portion may be provided at each flange receiving portion of the feed bobbin receiving portion and the reel bobbin receiving portion, which engages with a corresponding engagement portion of the flanges to function as a wind slack preventive portion.

In the holding mechanism, the first holding member may include a wind meandering preventive portion for preventing wind meandering of the strip film by contacting one side of the strip film so as to define lateral movement of the film.

In the holding mechanism, the first holding member may include a support portion that supports the first holding member such that, when the holding mechanism is disposed on a plane surface with the opening facing upward, the opening is substantially parallel with the plane surface.

In the holding mechanism, a bottom surface of the support portion may be a flat surface.

In the holding mechanism, the feed bobbin receiving portion and the reel bobbin portion of the first holding member may be so positioned that the feed bobbin receiving portion and the reel bobbin receiving portion can receive and hold the feed bobbin and the reel bobbin at an interval identical with that between the feed bobbin and the reel bobbin when printing.

In the holding mechanism, the first holding member may be formed of synthetic resin, and the second holding member may be formed of paper.

In the holding mechanism, the second holding member may have a cut-planned line at substantially the center portion thereof.

In the holding mechanism, the cut-planned line may be composed of perforations.

In the holding mechanism, the second holding member may have, on a surface facing the first holding member, an index for loading in place the replacement ink ribbon in an ink ribbon loading apparatus.

BEST MODE FOR CARRYING OUT THE INVENTION

Figure 1:
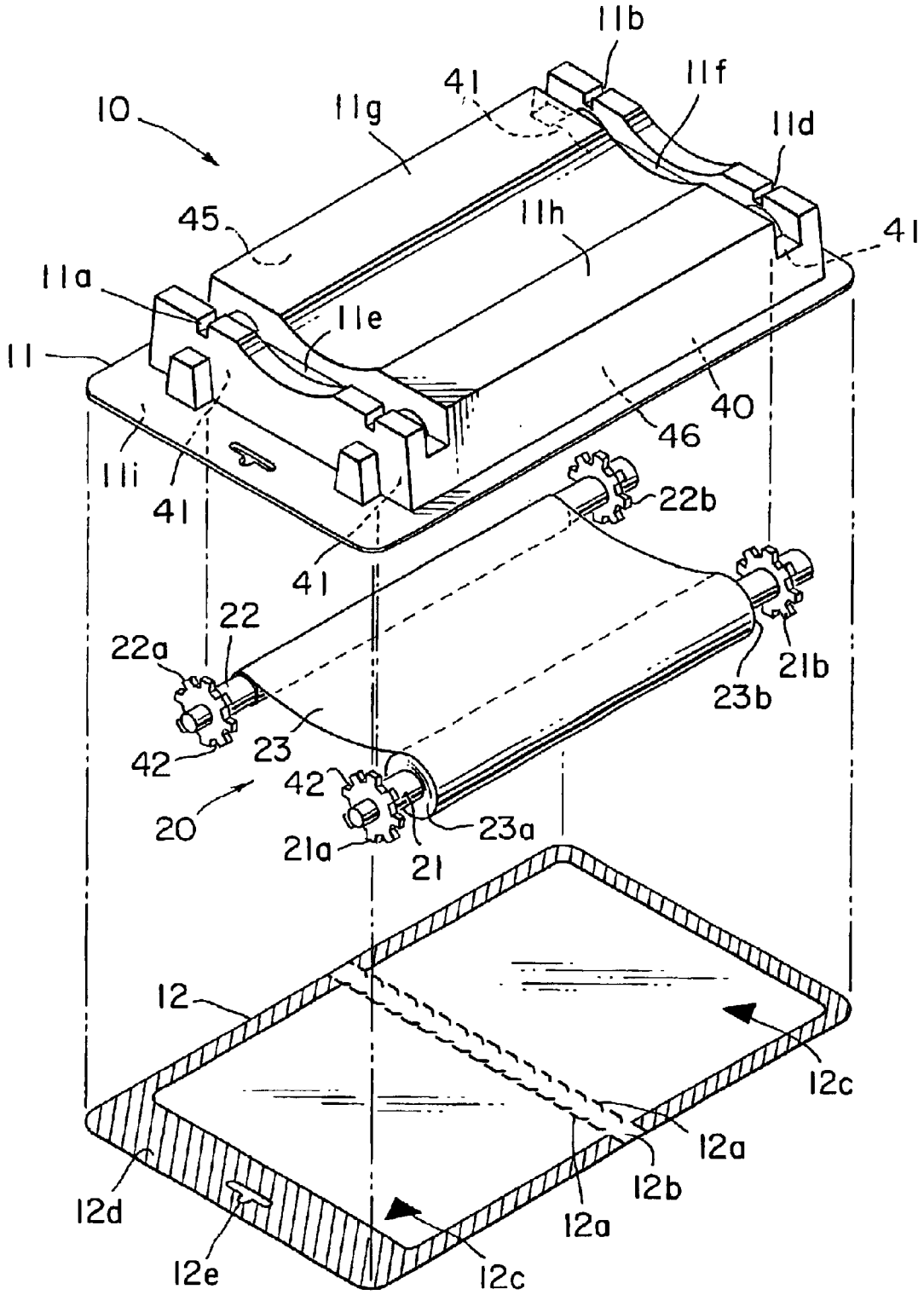
FIG. 1 is an exploded perspective view schematically illustrating an embodiment of a holding mechanism for a replacement ink ribbon according to the present invention.

An embodiment of the present invention will be hereinafter described with reference to the drawings. FIGS. 1 to 8 are views showing a holding mechanism for replacement ink ribbon according to the present invention.

The holding mechanism for replacement ink ribbon according to the present invention is to be employed when replacing ink ribbons, by improving a packaging form so-called blister package.

In FIGS. 1 to 8, a replacement ink ribbon 20 includes a feed bobbin 21 provided at one end of a thermal transfer strip film 23 and a reel bobbin 22 provided at the other end of the film 23.

A holding mechanism for replacement ink ribbon 10 according to the present invention holds such a replacement ink ribbon 20. The holding mechanism for replacement ink ribbon 10 includes a transparent shell (a first holding member) 11 having a feed bobbin receiving portion 40 for receiving and holding the feed bobbin 21 and a reel bobbin receiving portion 45 for receiving and holding the reel bobbin 22, with the transparent shell 11 having an opening 46 in one surface, and a board (a second holding member) 12 having a plate-shape for covering the opening 46 of the transparent shell 11.

The transparent shell 11 is obtained by forming a transparent and colorless PET (polyethylene terephthalate) sheet by vacuum molding. The transparent shell 11 covers the ink ribbon 20 with a portion other than the opening 46.

The feed bobbin 21 and the reel bobbin 22 respectively have flanges 21*a*, 21*b*, 22*a*, 22*b* at both ends thereof. The feed bobbin receiving portion 40 and the reel bobbin receiving portion 45 of the transparent shell 11 have flange receiving portions 41 (see FIG. 7) for receiving the corresponding flanges 21*a*, 21*b*, 22*a*, 22*b*.

Wind slack preventive portions (lock portions) 11*a*, 11*b*, 11*c*, 11*d* are provided at each flange receiving portion 41 of the transparent shell 11, which are engaged with grooves 42 (engagement portions) of the corresponding flanges 21*a*, 21*b*, 22*a*, 22*b* to prevent rotations of the feed bobbin 21 and the reel bobbin 22.

As described above, the wind slack preventive portions 11*a* to 11*d* prevent the rotations of the feed bobbin 21 and the reel bobbin 22 so as to avoid a wind slack of the film 23. The wind slack preventive portions 11*a* to 11*d* are concavely recessed when seen from outside, and are in engagement with the grooves 42 provided at the flanges 21*a*, 21*b*, 22*a*, 22*b*.

The transparent shell 11 also includes wind meandering preventive portions 11*e*, 11*f* which are concavely recessed when seen from outside. The wind meandering preventive portions 11*e*, 11*f* contact an end 23*a* of the film 23 provided on the feed bobbin 21 so as to prevent a wind meandering (axial displacement of the wind position) of the film 23.

On the opposite sides of the feed bobbin receiving portion 40 and the reel bobbin receiving portion 45 of the transparent shell 11, support portions 11*g*, 11*h* are provided. The support portions 11*g*, 11*h* support the overall holding mechanism 10. When the holding mechanism 10 is disposed on a plane surface P such as a desk surface with the transparent shell 11 positioned downward and the opening 46 facing upward, the opening 46 of the transparent shell 11 and a board 12 are substantially parallel with the plane surface P such as a desk surface. In the present embodiment, bottom surfaces of the support portions 11*g*, 11*h* are flat and parallel with the opening 46 of the transparent shell 11 and the board 12.

The transparent shell 11 has a flat joining surface 11*i*. The joining surface 11*i* is in heat bonded with a joining region 12*d* of the board 12, which is coated with an adhesive.

The board 12 is now explained. The board 12 is made of a thick paper fixed to the transparent shell 11. The board 12 has a pair of perforated lines 12*a*, a cut-planned portion 12*b* surrounded by a pair of perforated lines 12*a*, an index 12*c* provided at a surface facing the transparent shell 11, and the joining region 12*d* to be bonded to the joining surface 11*i* of the transparent shell 11, etc.

The perforated line 12*a* is a cut-planned line provided on both sides of the cut-planned portion 12*b*, which facilitates cutting of the board 12 when the cut-planned portion 12*b* is to be cut.

The cut-planned portion 12*b* is firstly to be cut when loading the ink ribbon 20 in a printer. The cut-planned portion 12*b* is not bonded to the transparent shell 11 for easily cutting the portion 12*b* from the other portion of the board 12.

The index 12*c* is provided on the inner surface of the board 12 on the side of the feed bobbin 21. The index 12*c* is provided on the board 12 at a region which is not bonded and is located near a shaft end of the feed bobbin 21.

The joining region 12*d* is provided on an outer peripheral portion of the inner surface of the board 12 to be bonded to the joining surface 11*i* of the transparent shell 11. The joining region 12*d* has a hook hole 12*e* to be used for hanging the holding mechanism on a hook or others when displayed in a shop.

The ink ribbon 20 is a replacement ink ribbon having the feed bobbin 21, the reel bobbin 22 and the film 23, as described above. A printer using the ink ribbon 20 of the present embodiment can carry out an A-4 size printing. The printer carries out a consecutive printing by means of a large-sized printer head. Thus, the ink ribbon 20 is made enlarged corresponding to the A-4 size.

As described above, the feed bobbin 21 and the reel bobbin 22 are shafts which have respectively the film 23 provided thereon. During use, the film 23 is sequentially reeled from the feed bobbin 21 to the reel bobbin 22. The feed bobbin 21 and the reel bobbin 22 respectively have flanges 21*a*, 21*b*, 22*a*, 22*b* near the shaft ends thereof. These flanges 21*a*, 21*b*, 22*a*, 22*b* have slit grooves 42.

The film 23 is a thermal transfer film including a thermal transfer layer containing a sublimating dye. The film 23 has one end provided at the feed bobbin 21 in tight contact therewith, and the other end provided at the reel bobbin 22 by using an adhesive tape or the like.

Figure 8:
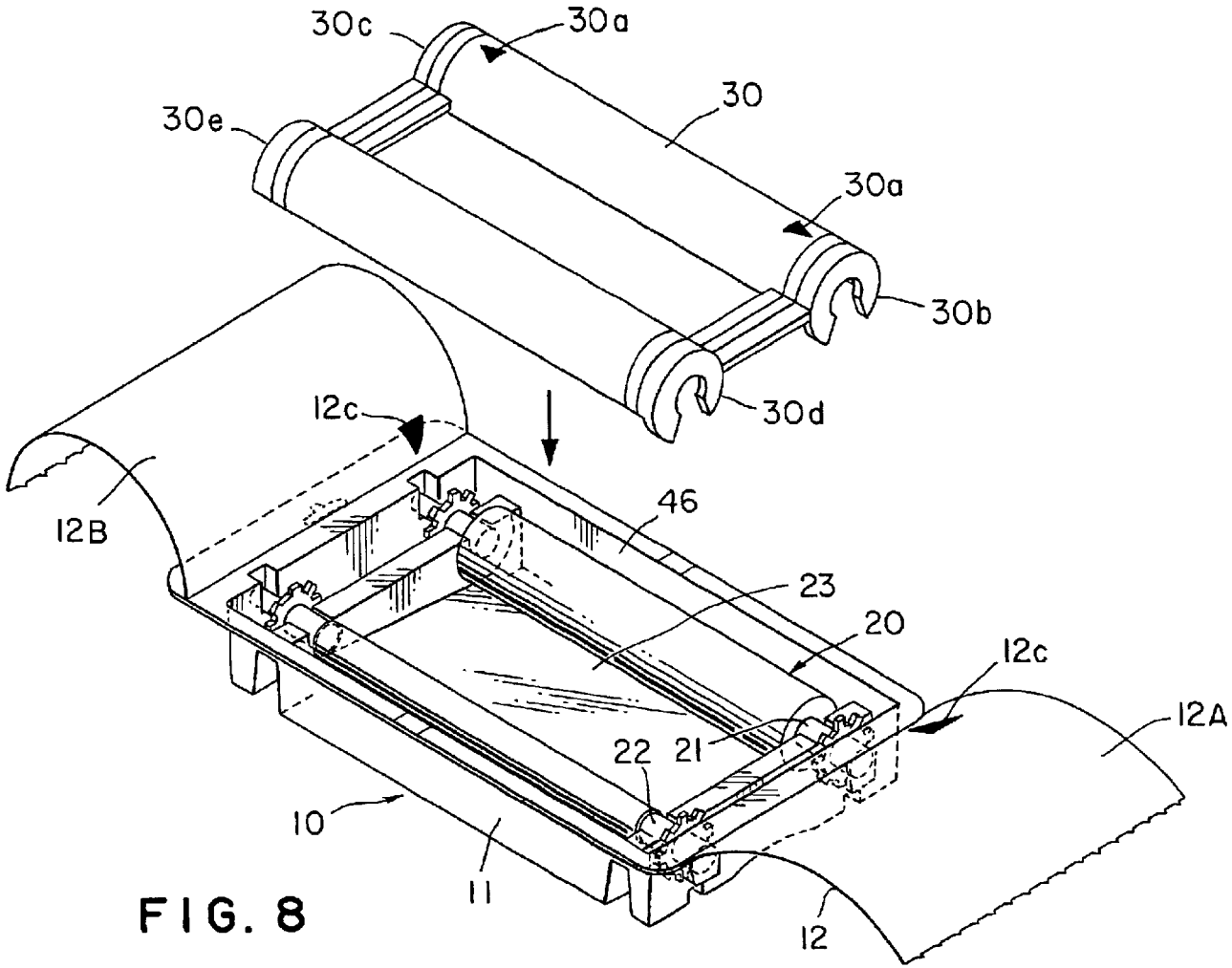
FIG. 8 is an explanatory view of a cassette.

The holding mechanism 10 serves to hold the ink ribbon 20 so that one can set the ink ribbon 20 without touching the ink ribbon 20, when loading the ink ribbon 20 to a cassette 30 (see FIG. 8). The holding mechanism 10 also serves as a package until the ink ribbon 20 is used.

Figure 7:
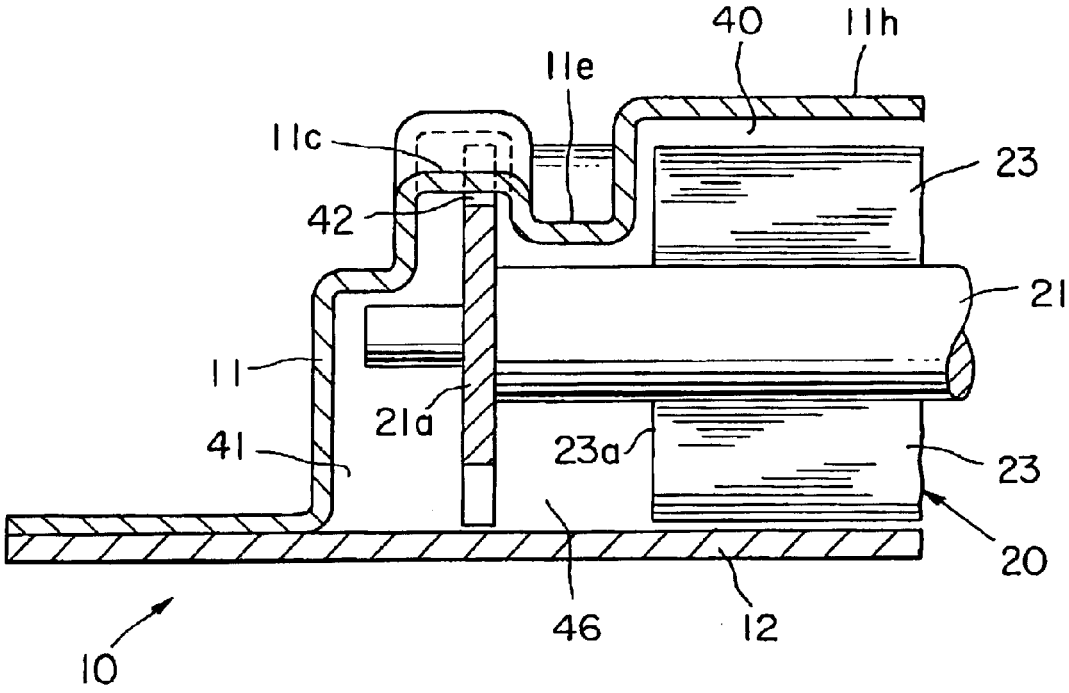
FIG. 7 is a cross-sectional view of a holding mechanism and a feed bobbin of an ink ribbon at the shaft center, which are in a packaged state.

FIG. 7 is a cross-sectional view of the holding mechanism 10 and the feed bobbin 21 of the ink ribbon 20 at the shaft center, which are in a packaged state.

In the packaged state, since the wind slack preventive portion 11*c* of the transparent shell 11 is engaged with the groove 42 provided at the flange 21*a* of the feed bobbin 21, the feed bobbin 21 is not rotated during a transportation so that a wind slack of the film 23 is prevented.

At the same time, the wind meandering preventive portion 11*e* bears down the end 23*a* of the film 23. Thus, even if vibrated during a transportation, the film 23 can be held in a right state without wind meandering thereof.

As to the portions other than those shown in FIG. 7, the wind slack preventive portions 11*a*, 11*b*, 11*d*, and wind meandering preventive portion 11*f* act in the same manner as the wind slack preventive portion 11*c* and the wind meandering preventive portion 11*e*.

A process for loading the ink ribbon 20 in the cassette (ink ribbon loading apparatus) 30 is hereinafter explained.

FIGS. 2 to 6 illustrate a process for loading the ink ribbon 20 in the cassette 30.

First, the holding mechanism 10 is disposed on a flat surface P such as a desk, with the transparent shell 11 facing downward and the board 12 facing upward. Since the transparent shell 11 is provided with the support portions 11*g*, 11*h* having flat bottom surfaces, the holding mechanism 10 can stably disposed on the plane surface P and the operations thereafter can be readily performed.

Figure 2:
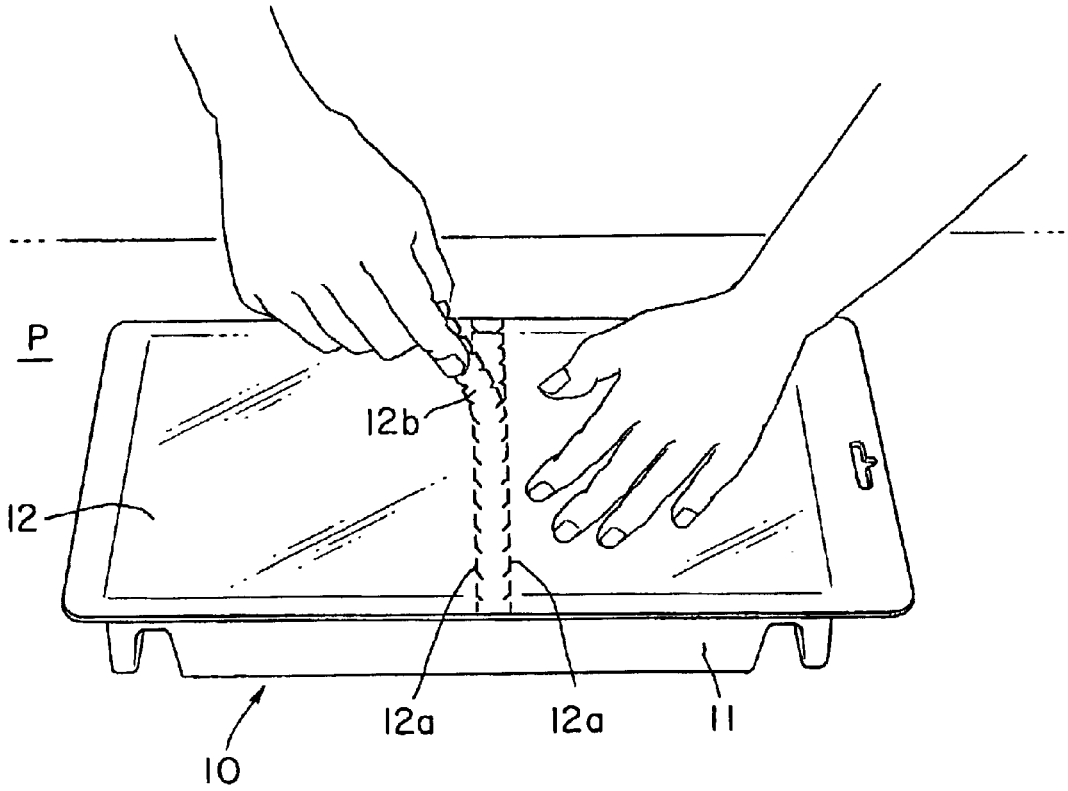
FIG. 2 is a view illustrating a manner of cutting a cut-planned portion.
Figure 3:
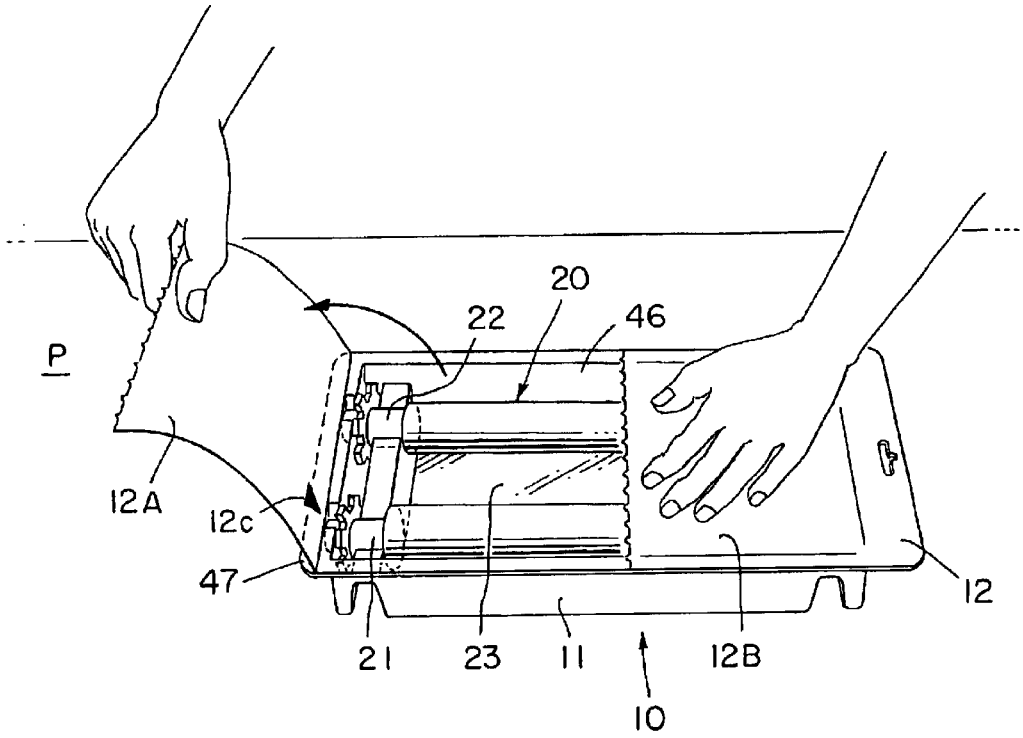
FIG. 3 is a view illustrating a manner of releasing a board.
Figure 4:
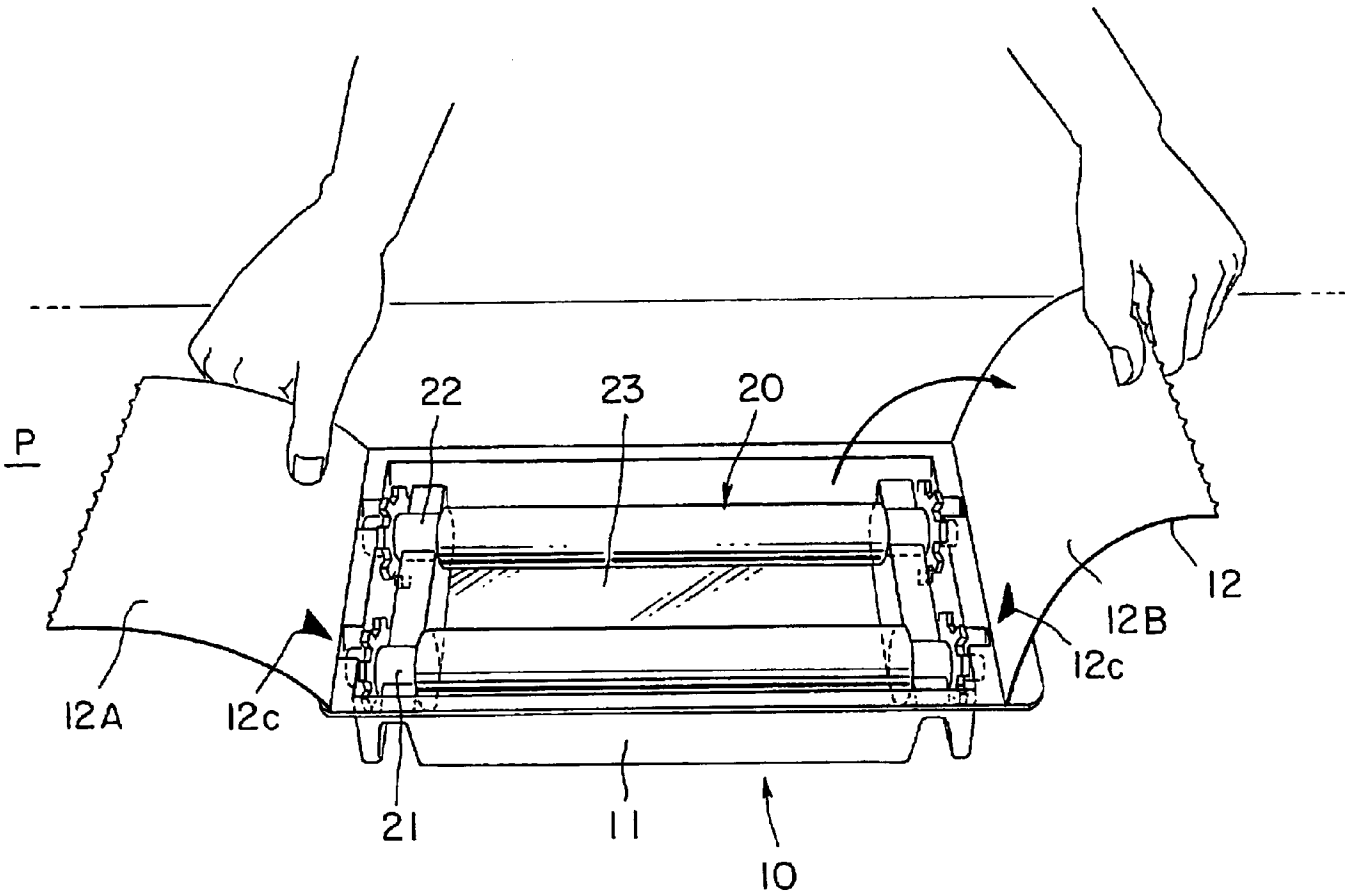
FIG. 4 is a view illustrating a manner of releasing a board.

Then, the cut-planned portion 12*b* of the board 12 is cut along the cut-planned line 12*a* (FIG. 2). By cutting the cut-planned portion 12*b*, the board 12 is divided into a board 12A and a board 12B. The boards 12A and 12B are sequentially released thereafter (FIGS. 3 and 4). However, the boards 12A and 12B are not fully released, with an end portion 47 of the board 12 left bonded to the transparent shell 11.

After the boards 12A and 12B are released to be in a state shown in FIG. 4, the ink ribbon 20 is to be loaded in the cassette 30.

FIG. 8 illustrates the cassette 30. The cassette 30 is provided in a printer not shown. The ink ribbon 20 is loaded in the printer through the cassette 30. The cassette 30 has a cassette index 30*a* and bearings 30*b* to 30*e*. The shafts of the feed bobbin 21 and the reel bobbin 22 are fit in the bearings 30*b* to 30*e*. The ink ribbon 20 is loaded in the printer together with the cassette 30.

Each interval between the bearings 30*b* to 30*e* of the cassette 30, namely an interval between the feed bobbin 21 and the reel bobbin 22 when printing, is identical with that between the feed bobbin receiving portion 41 and the reel bobbin receiving portion 45.

Figure 5:
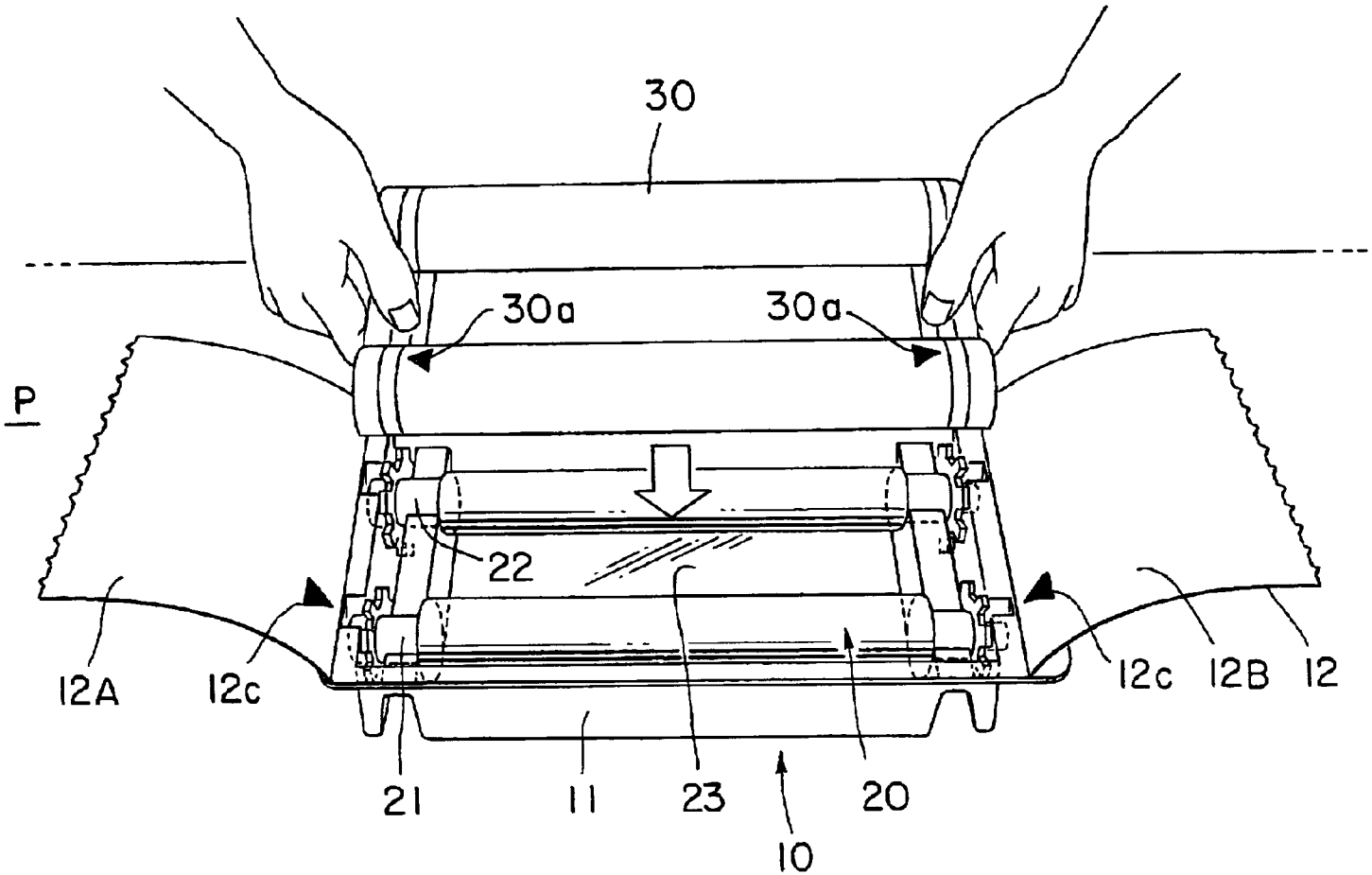
FIG. 5 is a view illustrating a step of loading an ink ribbon in a cassette.
Figure 6:
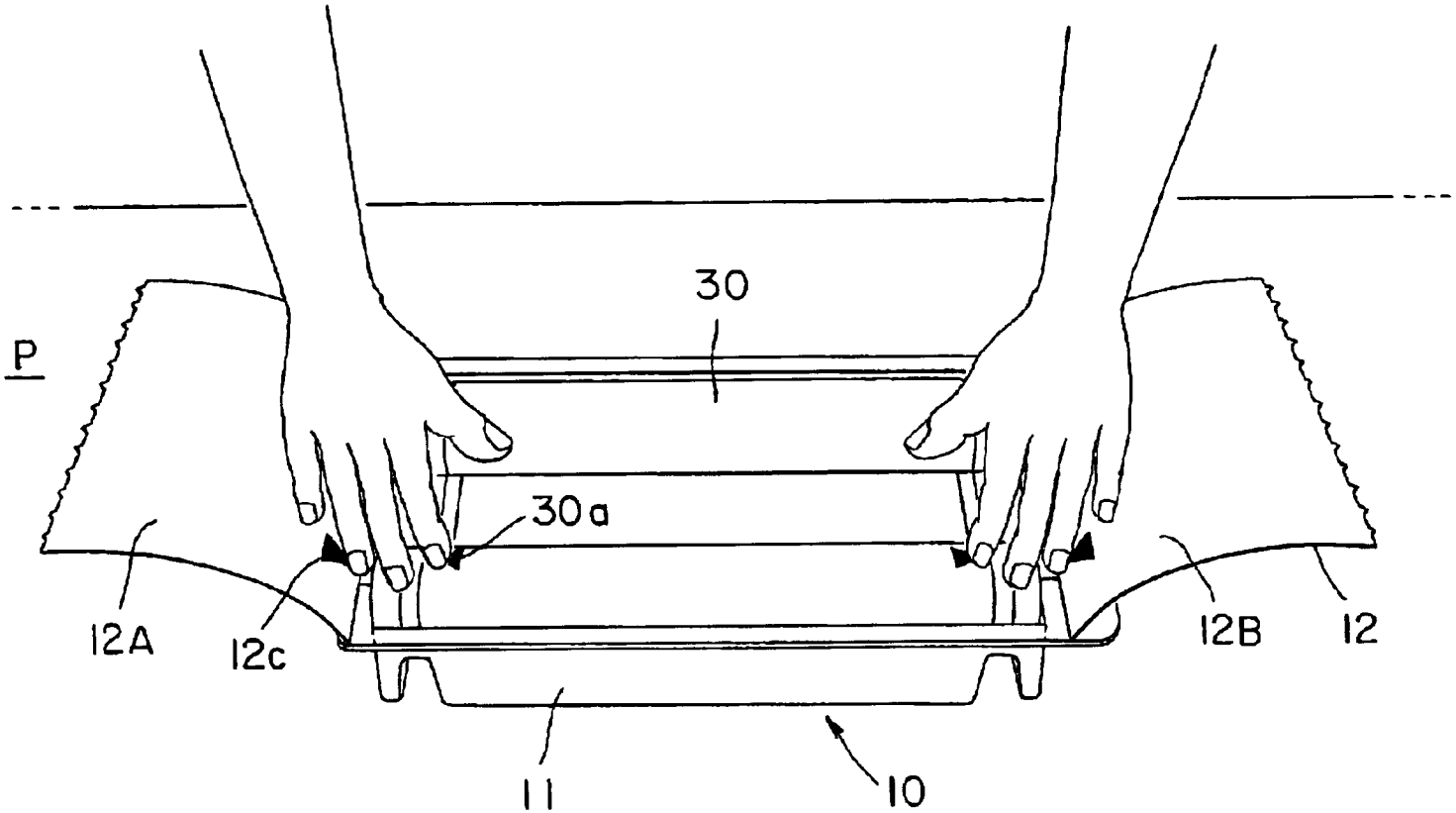
FIG. 6 is a view illustrating a manner of pushing a cassette into an ink ribbon from above.

When loading the ink ribbon 20 into the cassette 30, the cassette 30 is so oriented that the index 12*c* provided at the board 12 may be aligned with the index 30*a* provided at the cassette 30, as shown in FIG. 5, to thereby position the cassette 30 in a right loading direction with respect to the ink ribbon 20.

Then, the cassette 30 is pushed from above (FIG. 6) to securely fit the shafts of the feed bobbin 21 and the reel bobbin 22 in the four bearings 30*b* to 30*e*. Thus, the loading of the ink ribbon 20 in the cassette 30 is completed.

Since the intervals between the bearings 30*b* to 30*e* are identical with the interval between the feed bobbin receiving portion 41 and the reel bobbin receiving portion 45, the cassette 30 can be readily loaded to the ink ribbon 20 simply by pushing the cassette 30.

During the above loading operation of the ink ribbon 20 into the cassette 30, the wind slack and the wind meandering of the film are prevented by the wind slack preventive portions 11*a* to 11*d* and the wind meandering preventive portions 11*e*, 11*f*. Accordingly, the ink ribbon 20 can be readily loaded in the cassette 30 without displacement thereof.

According to the present embodiment, the transparent shell 11 has the wind slack preventive portions 11*a* to 11*d* to be engaged with the groove 42 provided at the flanges 21*a*, 21*b*, 22*a*, 22*b* of the feed bobbin 21 and the reel bobbin 22. Thus, the feed bobbin 21 and the reel bobbin 22 can be stably secured without rotation thereof, during a transportation and a loading operation of the ink ribbon 20 into the cassette 30. Therefore, the film 23 is prevented from being slack.

The transparent shell 11 has the wind meandering preventive portions 11*e*, 11*f*. Thus, the feed bobbin 21, the reel bobbin 22, and the film 23 can be stably secured in an axial direction, during a transportation and a loading operation of the ink ribbon 20 in the cassette 30 so that the wind meandering of the film 23 is prevented.

Since the transparent shell 11 is provided with the support portions 11*g*, 11*f* having the flat surfaces, the ink ribbon 20 and the holding mechanism 10 can be supported in a stable manner when loading the ink ribbon 20 into the cassette 30. Further, the ink ribbon 20 and the holding mechanism 10 can be superposed in a stable manner during a transportation and in a shop, etc.

According to the present embodiment, the ink ribbon 20 is held by the transparent shell 11 and the board 12, and loaded in the cassette 30 when it is to be used. Thus, it is not necessary to prepare a cassette attached to every ink ribbon, whereby a price of consumable article of the ink ribbon 20 can be lowered. As only one printer is needed for one cassette 30, it is economical with resources.

The board 12 has the perforated lines 12*a* provided at substantially the center portion thereof, and is to be opened from these lines one by one. Thus, it can be stably and readily opened without touching the ink ribbon 20.

Further, by providing the index 12*c* at the board 12, the index 30*a* at the corresponding portion of the cassette 30 can be aligned with the index 12*c*. Thus, the ink ribbon 20 can be readily and securely loaded into the cassette 30, keeping the right loading direction.

Variations

Not limited to the above-described embodiment, various changes and modifications can be made, which are within the equivalent scope of the present invention.

(1) In the above embodiment, the transparent shell 11 is transparent and colorless. However, not limited thereto, the transparent shell 11 may, for example, include additives to have a UV protection function so as to protect the ink ribbon 20.

(2) In the above embodiment, the ink ribbon 20 is loaded into the cassette 30. However, not limited thereto, the ink ribbon 20 may be, for example, directly loaded in a printer as an ink ribbon loading apparatus. In this case, for example, the transparent shell 11 may be held by hand when loading.

(3) In the above embodiment, the wind slack preventive portions 11*a* to 11*d* are engaged with the groove 42 provided at the flanges 21*a*, 21*b*, 22*a*, 22*b*. However, not limited thereto, for example, an engagement portion may be provided at the shafts of the feed bobbin 21 and the reel bobbin 22, and a lock portion to be engaged with the engagement portion may be additionally provided.

(4) In the above embodiment, the support portions 11*g*, 11*h* have the flat surfaces parallel with the board 12. However, not limited thereto, the support portions 11*g*, 11*h* may have, for example, a plurality of projected portions provided at the bottom surfaces thereof, each having the top end substantially in the same plane.

As described above in detail, according to the present invention, the holding mechanism for an ink ribbon includes a first holding member having a feed bobbin receiving portion and a reel bobbin receiving portion for respectively receiving a feed bobbin and a reel bobbin, and a second holding member for covering a whole area of an opening of the first holding member. Thus, positions of the feed bobbin and/or the reel bobbin can be secured during a transportation and a loading of an ink ribbon. Consequently, wind slack of the film can be prevented as well as the loading operation can be performed in a stable manner.

A wind slack of the film can be more efficiently prevented by providing a wind slack preventive portion at the first holding member.

The first holding member has a wind meandering preventive portion for preventing wind meandering of the film by bearing down at least one of the film ends in an axial direction of the bobbins. Thus, the feed bobbin, the reel bobbin and the film can be securely held in an axial direction during the transportation and the loading of the ink ribbon, and wind meandering of the film can be prevented.

As the first holding member includes a support portion, the ink ribbon and the holding mechanism for a replacement ink ribbon can be supported in a stable manner on a plane such as a desk, during the transportation and the loading operation of the ink ribbon. Further, the ink ribbon and the holding mechanism can be superposed in a stable manner during a transportation and in a shop.

Since the support portion of the first holding member has a flat bottom surface, the ink ribbon and the holding mechanism for a replacement ink ribbon can be supported in a stable manner on a plane such as a desk, and superposed in a stable manner during the transportation or in a shop. Further, the manufacturing of the holding mechanism can be facilitated because of the simple form. Permeability can be improved because of less irregular surface, and therefore the ink ribbon in the holding mechanism can be easily recognized from the outside.

According to the present invention, the holding mechanism includes the first holding member for covering the overall ink ribbon except an opened surface, with the feed bobbin and the reel bobbin being held with an interval therebetween which is substantially the same with that between the shafts of the feed bobbin and the reel bobbin when printing, and the second holding member for covering the full area of the opening of the first holding member. Thus, the ink ribbon can be loaded into a printer or a cassette or others in a simple manner.

The first holding member is formed of transparent or translucent resin, and the second holding member is formed of opaque board. Thus, the ink ribbon contained in the holding mechanism and the state thereof can be easily recognized in a shop before being used. Therefore, the ink ribbon can be prevented from being damaged or touched when opened.

The second holding member includes cut-planned lines at substantially the center portion thereof. Thus, the second holding member can be divided half and half, which facilitates the opening operation, without damaging or touching the ink ribbon when it is opened.

The cut-planned lines can be provided at an extremely low price because it is composed of perforations.

As the second holding member includes an index for indicating a loading position with respect to the printer and/or cassette, the ink ribbon can be readily and securely loaded, with keeping a right loading direction of the ink ribbon.

What is claimed is:

1. A holding mechanism for holding a replacement ink ribbon comprising a feed bobbin located at one end of a strip film and a reel bobbin located at the other end of the strip film, comprising:

a first holding member having a feed bobbin receiving portion for receiving and holding the feed bobbin and a reel bobbin receiving portion for receiving and holding the reel bobbin, with the first holding member having an opening; and a second holding member having a plate-shape for covering the opening of the first holding member, wherein the first holding member is made of synthetic resin, the second holding member is made of paper, the second holding member has a cut-planned line, the feed bobbin and the reel bobbin each comprising flanges at both ends thereof, the feed bobbin receiving portion and the reel bobbin receiving portion each comprising flange receiving portions for receiving the corresponding flanges, and a lock portion is located at each flange receiving portion of the feed bobbin receiving portion and the reel bobbin receiving portion, which engages with a corresponding engagement portion of the flanges to function as a wind slack preventive portion.

2. The holding mechanism according to claim 1, further comprising a wind slack preventive portion located in at least one of the feed bobbin receiving portion and the reel bobbin receiving portion, for preventing a rotation of the feed bobbin or the reel bobbin.

3. The holding mechanism according to claim 1, wherein the first holding member comprises a planar member having said opening thereon, a support portion that supports the first holding member such that, when the holding mechanism is located on a plane surface with the opening facing upward, the planar member having the opening is substantially parallel with the plane surface.

4. The holding mechanism according to claim 3, wherein a bottom surface of the support portion is a flat surface.

5. The holding mechanism according to claim 1, wherein the feed bobbin receiving portion and the reel bobbin portion of the first holding member are so positioned that the feed bobbin receiving portion and the reel bobbin receiving portion can receive and hold the feed bobbin and the reel bobbin at an interval identical with that between the feed bobbin and the reel bobbin when printing.

6. The holding mechanism according to claim 1, wherein the second holding member has a cut-planned line at substantially the center portion thereof.

7. The holding mechanism according to claim 6, wherein the cut-planned line comprises perforations.

8. The holding mechanism according to claim 1, wherein the second holding member further comprises, on a surface facing the first holding member, an index for loading replacement ink ribbon in an ink ribbon loading apparatus.

9. A holding mechanism for holding a replacement ink ribbon, comprising:

a feed bobbin located at one end of a strip film and a reel bobbin located at the other end of the strip film;

a first holding member having a feed bobbin receiving portion for receiving and holding the feed bobbin and a reel bobbin receiving portion for receiving and holding the reel bobbin, with the first holding member having an opening; and a second holding member having a plate-shape for covering the opening of the first holding member, wherein the first holding member is made of synthetic resin, the second holding member is made of paper, and the second holding member has a cut-planned line, the first holding member comprises a wind meandering preventive portion for preventing wind meandering of the strip film by contacting one side of the strip film to control lateral movement of the film.

10. A holding mechanism in combination with a replacement ink ribbon, comprising:

a replacement ink ribbon comprising a feed bobbin located at one end of a strip film and a reel bobbin located at another end of the strip film, a first holding member having a feed bobbin receiving portion for receiving and holding the feed bobbin and a reel bobbin receiving portion for receiving and holding the reel bobbin, with the first holding member having an opening; and a second holding member having a plate-shape for covering the opening of the first holding member, wherein the first holding member comprises synthetic resin, the second holding member comprises paper, and the second holding member has a cut-planned line.

11. The holding mechanism in combination with a replacement ink ribbon according to claim 10, further comprising a wind slack preventive portion located in at least one of the feed bobbin receiving portion and the reel bobbin receiving portion, for preventing a rotation of the feed bobbin or the reel bobbin.

12. The holding mechanism in combination with a replacement ink ribbon according to claim wherein the feed bobbin and the reel bobbin each comprising flanges at both ends thereof, and wherein the feed bobbin receiving portion and the reel bobbin receiving portion each comprises flange receiving portions for receiving the corresponding flanges.

13. The holding mechanism in combination with a replacement ink ribbon according to claim 12, wherein a lock portion is located at each flange receiving portion of the feed bobbin receiving portion and the reel bobbin receiving portion, which engages with a corresponding engagement portion of the flanges to function as a wind slack preventive portion.

14. The holding mechanism in combination with a replacement ink ribbon according to claim 10, wherein the first holding member comprises a wind meandering preventive portion for preventing wind meandering of the strip film by contacting one side of the strip film to control lateral movement of the film.

15. The holding mechanism in combination with a replacement ink ribbon according to claim 10, wherein the first holding member comprises a planar member having said opening thereon, a support portion that supports the first holding member such that, when the holding mechanism is located on a plane surface with the opening facing upward, the planar member having the opening is substantially parallel with the plane surface.

16. The holding mechanism in combination with a replacement ink ribbon according to claim 15, wherein a bottom surface of the support portion is a flat surface.

17. The holding mechanism in combination with a replacement ink ribbon according to claim 10, wherein the feed bobbin receiving portion and the reel bobbin portion of the first holding member are so positioned that the feed bobbin receiving portion and the reel bobbin receiving portion can receive and hold the feed bobbin and the reel bobbin at an interval identical with that between the feed bobbin and the reel bobbin when printing.

18. The holding mechanism in combination with a replacement ink ribbon according to claim 10, wherein the second holding member has a cut-planned line at substantially the center portion thereof.

19. The holding mechanism in combination with a replacement ink ribbon according to claim 18, wherein the cut-planned line comprises perforations.

20. The holding mechanism in combination with a replacement ink ribbon according to claim 10, wherein the second holding member further comprises, on a surface facing the first holding member, an index for loading replacement ink ribbon in an ink ribbon loading apparatus.

* * * * *